United States Patent [19]

Blaser et al.

[11] 4,281,741

[45] Aug. 4, 1981

[54] COMPACT EXHAUST SILENCER FOR DIESEL LOCOMOTIVES

[75] Inventors: Dwight A. Blaser, Sterling Heights, Mich.; David J. Goding, Willow Springs, Ill.

[73] Assignee: General Motors Corporation, Detroit, Mich.

[21] Appl. No.: 80,475

[22] Filed: Oct. 1, 1979

[51] Int. Cl.[3] ..... F01N 1/02

[52] U.S. Cl. ..... 181/250

[58] Field of Search ..... 181/227, 228, 247–251, 181/255, 266, 273, 276

[56] References Cited

U.S. PATENT DOCUMENTS

| | | | |
|---|---|---|---|
| Re. 25,909 | 11/1965 | Ludlow et al. | 181/276 X |
| 3,434,565 | 3/1967 | Fischer | 181/250 |
| 3,690,406 | 9/1972 | Weiss | 181/227 |

FOREIGN PATENT DOCUMENTS

| | | | |
|---|---|---|---|
| 1052144 | 1/1954 | France | 181/273 |

*Primary Examiner*—L. T. Hix
*Assistant Examiner*—Thomas H. Tarcza
*Attorney, Agent, or Firm*—Robert J. Outland

[57] ABSTRACT

A compact exhaust silencer especially for use in diesel locomotives having a single exhaust outlet located in relatively close proximity to the roof of the engine hood. The silencer includes an offset duct having dual oppositely curved ninety degree bends, leading to a roof outlet opening and providing broadband high frequency sound level reduction, combined with a compact Helmholtz cavity-type resonator. The resonator consists of a chamber mounted near the first bend in the direction opposite the main duct offset and a connector tube extending from the side of the duct downwardly into the chamber and tuned with the cavity to the sound frequency at which maximum silencing is desired, preferably the predominant firing frequency in the engine noise spectrum at full speed and load.

5 Claims, 3 Drawing Figures

COMPACT EXHAUST SILENCER FOR DIESEL LOCOMOTIVES

TECHNICAL FIELD

This invention relates to engine exhaust silencers and more particularly to a compact silencer arrangement particularly applicable to diesel locomotives.

BACKGROUND OF THE INVENTION

Throughout the early history of railroad locomotives both steam and diesel powered, there was relatively little use of engine exhaust silencers or mufflers, especially in so-called road locomotives. There was some use of mufflers on special locomotives for use in mines and other enclosed applications and spark arresting devices not especially intended for sound reduction have been extensively applied in the past.

With the advent of turbocharging of diesel powered locomotives, it was observed that directing the exhaust gases through the turbine had the effect of reducing the transmitted sound levels of certain frequencies of exhaust noise so that the exhaust from turbocharged locomotives appeared to be quieter than that from naturally aspirated locomotives. More recently however, the desire for further reductions in artifically produced noise in the environment has lead to the availability of exhaust silencing devices for both turbocharged and naturally aspirated locomotives designed for domestic use.

There is currently available an exhaust silencer designed for use with turbocharged diesel powered domestic road-type locomotives having a single elongated exhaust outlet, opening upwardly from the turbine. This silencer includes a dual bend offset outlet conduit, defining a passage that provides broadband sound reduction in the medium and high frequency range, combined with a large tank-like chamber surrounding the lower portion of the outlet conduit and connected thereto by perforations through the conduit wall, so as to provide sound reduction in the lower frequency ranges.

Recently, it has been desired to provide an exhaust silencer of similar effectiveness for turbocharged diesel-powered export model locomotives sold for overseas use. However, because of the lower exterior height of the export model locomotives, designed to meet the lower clearance requirement of many overseas railways, the space available within the engine hood section of the locomotive carbody of the export locomotives is not adequate to permit application of the previously designed domestic locomotive exhaust silencer arrangement.

SUMMARY OF THE INVENTION

The present invention provides a new compact exhaust silencer arrangement having sound reduction capabilities similar in character to those of the currently available silencer for domestic road-type locomotives but suitable for application in the much smaller clearance space available in turbocharged diesel-powered export type locomotives, as well as in other applications wherein limited clearance space may be available between a single exhaust outlet and the adjacent carbody closure panel.

A feature of the present invention is that it includes a close coupled offset exhaust conduit having a generally rectangular cross section and offset in the narrow direction of the rectangular area through a dual bend passage that provides broadband sound reduction at frequencies above 500 Hertz by forming an indirect path for sound propagation to the outlet that results in dissipation by requiring multiple reflections off the duct walls and some reflections back toward the silencer inlet.

A further feature of the invention is the additional provision of a Helmholtz type cavity resonator which includes a moderately sized chamber secured near the base of the outlet duct on the side opposite the direction of duct offset and a wide connector tube extending from the outlet duct near its base into the resonator chamber, the tube size and length being related to the volume of the chamber to provide a tuning of natural frequency that corresponds with the frequency at which maximum silencing is desired, preferably the predominant firing frequency in the engine exhaust noise spectrum at full speed and load.

These and other features of the invention will be more fully understood from the following description of a preferred embodiment taken together with the accompanying drawing.

BEST MODE FOR CARRYING OUT THE INVENTION

Figure 1:
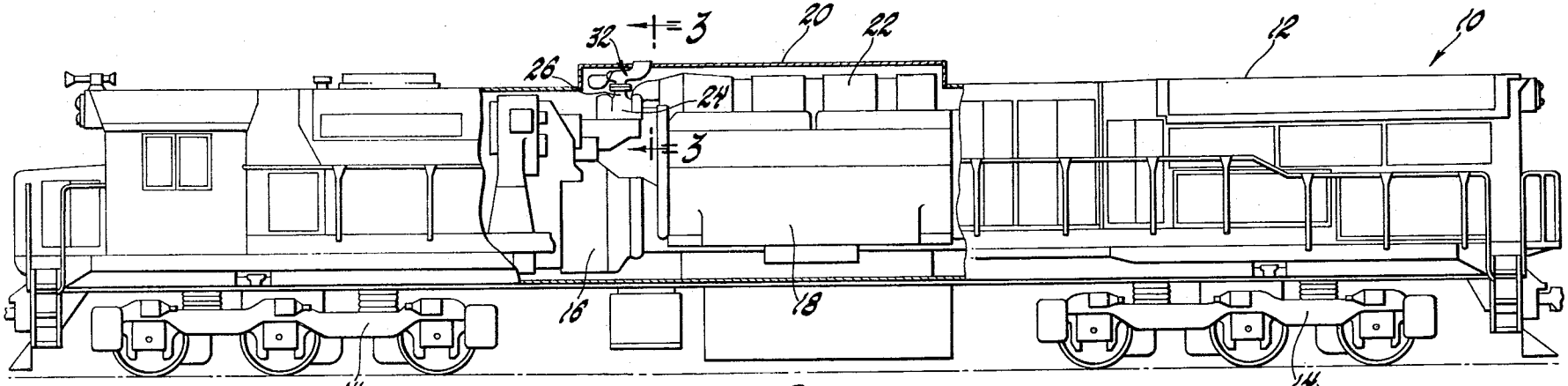
FIG. 1 is a side elevational view of a turbocharged engine powered diesel locomotive with portions broken away to show the engine and associated exhaust silencer formed in accordance with the invention.
Figure 3:
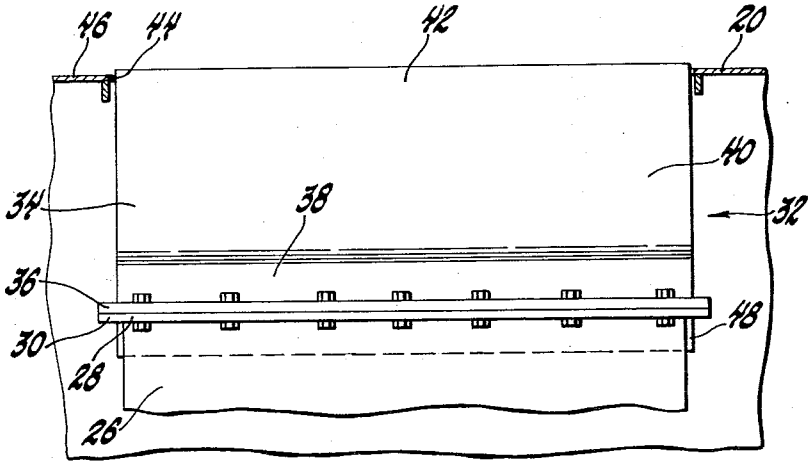
FIG. 3 is a fragmentary cross-sectional view from the plane indicated by the line 3—3 of FIG. 1 to further illustrate the construction and installation of the exhaust silencer.
Figure 2:
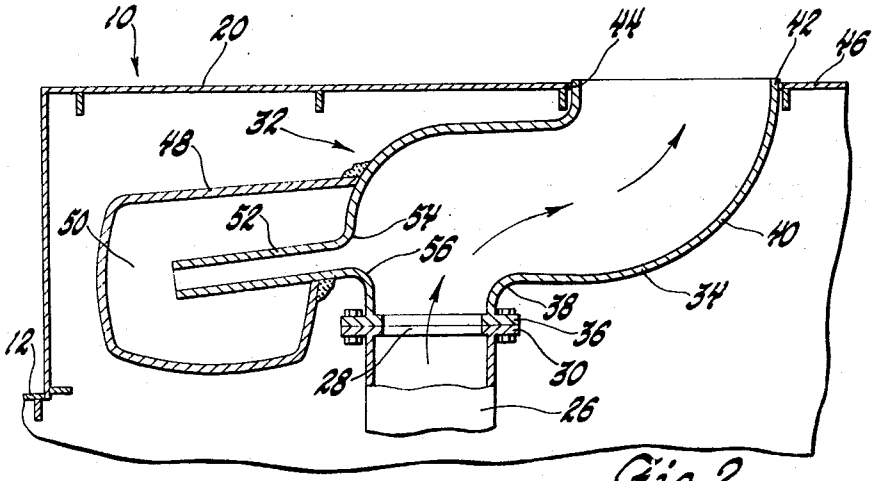
FIG. 2 is an enlarged view of the exhaust silencer mounting portion of FIG. 1 wherein the silencer is shown in longitudinal section to illustrate its interior construction.

Referring now to the drawing in detail, numeral 10 generally indicates a six axle export type railway road locomotive constructed in a manner generally representative of commercial export type locomotives of relatively low profile. Locomotive 10 includes a carbody 12 supported on two six axle motor driven railway trucks 14 powered by an electric generator 16 coupled to a diesel engine 18 mounted within the carbody 12. The carbody includes a raised central portion 20 which provides clearance for an engine exhaust manifold 22 that collects exhaust gases from the engine cylinders and directs them into the turbine of a turbocharger 24 mounted on one end of the engine.

The turbocharger has an exhaust gas outlet member 26 that terminates in an upwardly opening rectangular exhaust outlet 28 having a surrounding flange 30, the exhaust outlet and flange being relatively narrow in the longitudinal direction of the locomotive and much wider in the transverse direction. A relatively limited space exists within the raised central portion above and on either side of the exhaust outlet and its associated mounting flange 30.

In order to provide the desired silencing in accordance with the invention, the locomotive 10 is provided with a compact engine exhaust silencer formed in accordance with the invention and generally indicated by numeral 32. Silencer 32 includes a passage defining outlet duct 34 having a lower flange 36 that mounts upon the flange 30 of the turbocharger exhaust outlet. The duct 34 extends upwardly from the flange to a close coupled sharply curved right angle bend at 38, at which point the flange is offset in longitudinal direction toward the rear of the locomotive. It then turns upwardly at a second sharply curved right angle bend 40, terminating in a short upwardly facing end section 42 that protrudes through an opening 44 formed in the upper wall 46 of the raised central portion of the locomotive carbody. The longitudinal offset of the outlet duct 34 is sufficient so that sound waves emanating from the turbocharger exhaust outlet 28 into the duct are reflected by the duct walls at least twice before exiting from the opening in the end section 42.

The compact character of the construction in the vertical direction is illustrated by the fact that in the illustrated embodiment, the height of the duct from the base flange 36 to the end 42 is less than half the width of the duct 34 in its lateral direction.

On the forward side of the outlet duct, opposite the direction of offset, the exhaust silencer is provided with a tank-like enclosure 48 defining internally a Helmholtz resonator chamber 50. The chamber forming enclosure 48 extends forwardly of the main duct, filling available space within the locomotive carbody raised portion and having a lateral (side-to-side) length in the locomotive equal to the lateral width of the outlet duct 34. The chamber 50 is connected with the interior of the outlet duct 34 by a connector tube 52 which extends slightly downwardly from the front side of the outlet duct for a predetermined length into the cavity. Tube 52 is relatively narrow in its vertical extent, but has a lateral width equal to the width of the outlet duct.

The volume of the resonator chamber 50 and the volume within the connector tube 52 are preselected by proper dimensioning of these items to operate in accordance with known Helmholtz resonator principles in which the gas in the chamber acts as a spring and the gas within the tube acts as a mass vibrating against the spring.

The inner end 54 of the upper side of the tube 52 is stepped in slightly from the corresponding end 56 of the lower side to reduce interference of the main gas flow in the outlet duct 34 with the effective length of the vibrating mass in the connector tube 52.

By proper sizing, the natural frequency of chamber and tube combination is made to correspond with the frequency at which maximum silencing is desired. This frequency is preferably the predominate firing frequency in the engine exhaust noise spectrum when the engine is operating at full speed and load. It would, however, be possible to select another resonant frequency for tuning of the chamber if desired.

In operation, the offset outlet duct portion with its back-to-back dual ninety degree bends provides broadband sound reduction at frequencies above about 500 Hertz through the provision of an indirect path for sound propagation to the outlet. This results in dissipation of some of the sound by requiring multiple reflections off the duct walls in order to reach the outlet. Further, some of the sound is reflected back toward the silencer inlet. In addition, the Helmholtz resonator on the front of the outlet duct provides additional silencing particularly in and near the natural frequency of the resonating system, which preferably corresponds with the predominate firing frequency in the exhaust noise spectrum of the engine at full speed and load. The overall effect is to provide reductions in transmitted noise from the engine exhaust roughly equivalent to the reductions obtained by the much larger chamber type silencer previously made available for domestic road-type locomotives but in a package much more compact and fitting within the limited space available in the lower height export-type road locomotives.

While the invention has been described by reference to a single preferred embodiment shown for purposes of illustration, it should be understood that numerous changes might be made in the construction and features of the described embodiment without departing from the inventive concepts taught. Accordingly, it is intended that the invention not be limited to the illustrated embodiment, but have the full scope permitted by the language of the following claims.

The embodiments of the invention in which an exclusive property or privilege is claimed are defined as follows:

1. A compact exhaust silencer for use with diesel locomotives of the type having a single elongated exhaust outlet with limited clearance space from the outlet to the locomotive body wall, said silencer comprising;

a mounting base connectable to the exhaust outlet and defining an opening of greater length than width, a close coupled duct member with two oppositely curving sharply angled bends extending from said base to an outlet opening spaced axially from the base and to one side thereof in the direction of the narrow sides of the base, said duct bends providing broadband reduction of high frequency exhaust noise by forming an indirect path for sound propagation to the outlet, a compact Helmholtz resonator chamber disposed along the side of said duct opposite to said one side toward which the outlet is offset, and a connector pipe opening through said opposite duct side near the base and extending into said chamber in a direction generally opposite the direction of offset of the main duct to encompass a mass of gas tuned to the volume of said chamber to dampen exhaust noise at a desired frequency for maximum silencing effect under predetermined operating conditions.

2. A compact exhaust silencer for use with diesel locomotives of the type having a single elongated exhaust outlet with limited clearance space from the outlet to the locomotive body wall, said silencer comprising;

a mounting base connectable to the exhaust outlet and defining an opening of greater length than width, a close coupled duct member with two oppositely curving sharply angled bends extending from said base to an outlet spaced axially from the base and to one side thereof in the direction of the narrow sides of the base, said duct bends providing broadband reduction of high frequency exhaust noise by forming an indirect path for sound propagation to the outlet, a compact Helmholtz resonator chamber disposed along the side of said duct opposite to said one side toward which the outlet is offset, said chamber having a length dimension not substantially less than and coextensive with the width of said opposite side of said duct, and a connector pipe opening through said opposite duct side near the base and extending into said chamber in a direction generally opposite the direction of offset of the main duct, said connector pipe being of width about equal to that of said duct opposite side and extending into said resonator chamber to encompass a mass of gas tuned to the volume of said chamber to dampen exhaust noise at a desired frequency for maximum silencing effect under predetermined operating conditions.

3. A silencer as defined in claim 1 or 2 wherein said connector pipe and resonator are sized for maximum silencing at the predominant firing frequency in the engine noise spectrum at full engine speed and load.

4. A silencer as defined in claim 1 or 2 wherein the length of said base and said resonator chamber and the associated width of said duct and said connector pipe are more than twice the height of said duct outlet from said base.

5. A silencer as defined in claim 1 or 2 wherein the inner end of the side of the connector tube away from the base is stepped away from the flow stream in the duct relative to the corresponding end of the side of the connector tube toward the base to reduce interference of the main gas flow in the duct with vibration of the air mass in the connector tube.

* * * * *